United States Patent [19]

Wahlström et al.

[11] 4,348,781

[45] Sep. 14, 1982

[54] HOSE CLEANING PLANT

[75] Inventors: Hans V. Wahlström, Bergasstigen 3, 182 33 Danderyd; Rolf E. Nilsson, Uttervägen 9, 195 00 Märsta, both of Sweden; Kjell A. Pihlgren, Upplands Väsby, Sweden

[73] Assignees: Hans V. Wahlström, Danderyd; Rolf E. Nilsson, Märsta, both of Sweden

[21] Appl. No.: 249,839

[22] Filed: Apr. 1, 1981

[51] Int. Cl.[3] ..... A46B 13/02; D06G 1/00

[52] U.S. Cl. ..... 15/40; 134/64 R

[58] Field of Search ..... 15/40; 134/199, 122 R, 134/64 R

[56] References Cited

U.S. PATENT DOCUMENTS

| | | | |
|---|---|---|---|
| 2,909,794 | 10/1959 | McGraw et al. | 15/40 |
| 4,206,526 | 6/1980 | Bertram | 15/40 |
| 4,280,672 | 7/1981 | Santos et al. | 15/40 X |

*Primary Examiner*—Edward L. Roberts

*Attorney, Agent, or Firm*—Fleit & Jacobson

[57] ABSTRACT

A hose cleaning plant comprises an elongated horizontal receptacle (10) in which a number of hoses (16) may be placed side by side in extended positions, washing equipment (13) provided at one end of the receptacle (10), and a transport device (18) which is movable along the receptacle to draw a hose (16) through the washing equipment and along the receptacle (10), above the same. In order to make it possible, upon completion of a washing operation on a hose (16), to have the hose laid down in proper position in the receptacle (10) without considerable manual efforts, said transport device is formed by a carriage (18) which is supported on rails (19), provided adjacent to the longitudinal upper edges of the receptacle (10), and which is provided with means (20) for releasably holding an end portion of a hose (16) in a selected position in the transversal direction of the receptacle (10).

6 Claims, 2 Drawing Figures

HOSE CLEANING PLANT

Figure 1:
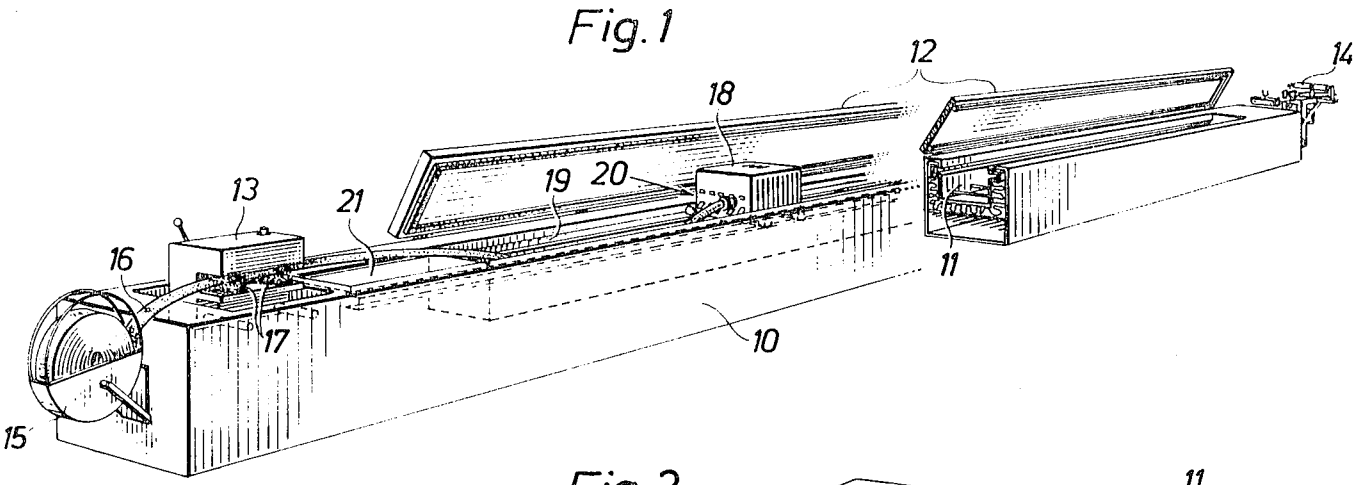

The present invention relates to a plant for use in connection with cleaning fire-hoses or other similar hoses. More particularly, the invention relates to such a plant of the kind comprising an elongated horizontal receptacle in which a plurality of hoses may be placed side by side in extended positions, a washing equipment provided at one end of the receptacle, and a transport device which is movable along the receptacle and by which a hose may be drawn through the washing equipment and along the receptacle, over the same, in order to be laid down in the receptacle upon completion of a washing operation on the hose.

In prior art hose cleaning plants of said kind, the type of transport device used has been found very unfavourable in practice, as it has made it necessary to rely on considerable manual efforts to ensure that the hoses are properly placed in intended side by side positions in the receptacle, which serves as a drying chamber.

An object of the invention is to avoid the above disadvantage and to reduce to a minimum the manual work required to ensure that the hoses are properly placed in intended positions in the receptacle.

According to the invention, for this purpose, there is provided a hose cleaning plant of said kind, which is characterized primarily in that the transport device is formed by a carriage which is supported on rails provided adjacent to the longitudinal upper edges of the receptacle, and which is provided with means for releasably holding an end portion of a hose in a selected position in the transversal direction of the receptacle. By using such a carriage, it is possible to ensure that a hose will assume the desired position in the transversal direction of the receptacle when drawn along the receptacle by said device.

The hose holding means of the carriage may comprise a number of stationary hose holders which are located at spaced apart positions in the transversal direction of the carriage. Alternatively, said means may consist of a single hose holder which is adjustable in the transversal direction of the carriage. The hose holding means may preferably be adapted to permit a hose held thereby to be released through remote controlled operation of said means.

In order to prevent a hose from being subjected to an excessive tension when drawn along the receptacle by the carriage, the carriage may be arranged to be stopped automatically when the tension in the hose reaches a predetermined value. Such an automatic stop function may be obtained by distributing the weight of the carriage in such a manner as to ensure that the driven wheels of the carriage will start skidding on the rails when the tension in the hose reaches said value.

To further facilitate an appropriate positioning of a hose in the receptacle, the washing device should preferably be adjustable in the transversal direction of the receptacle, hereby permitting its position to be adapted to a selected position for the connection between a hose and the carriage.

Figure 2:
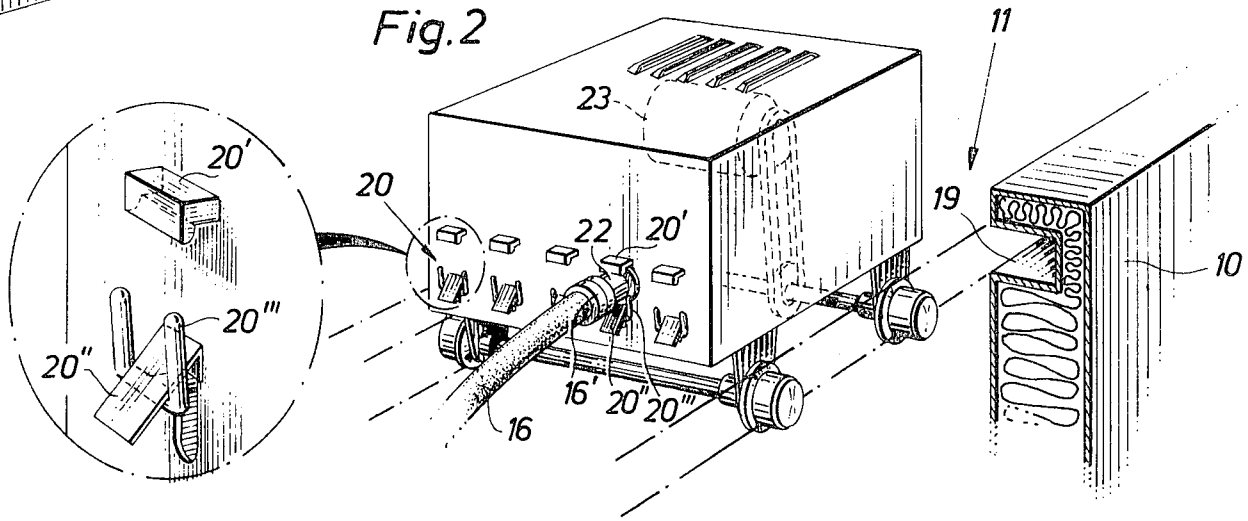

Below the invention will be described in further detail, reference being had to the accompanying diagrammatic drawing, in which:

FIG. 1 is a perspective view, showing a hose cleaning plant according to an embodiment of the invention, selected by way of example, while FIG. 2 is a perspective detailed view, on an enlarged scale, showing a carriage of said plant serving as a hose transport device.

The hose cleaning plant shown in the drawing comprises an elongated horizontal receptacle 10 defining a drying chamber 11 in which a plurality of hoses may be laid down side by side in extended positions. The drying chamber 11 may be closed by means of a cover 12. At one end of the receptacle 10, there is provided a hose washing equipment 13, and at the other end of the receptacle, there is provided a hose winder 14. A trough-shaped hose magazine 15 is provided in front of the washing equipment 13. A hose 16, to be cleaned in the plant, may be placed in helically coiled state in said magazine in order to be successively withdrawn therefrom and through washing equipment 13, in which the hose 16 is cleaned by being sprayed with water and forced to pass between pairs of opposite rotating brushes 17.

Reference numeral 18 designates a carriage which serves as a hose transport device and which is movable on rails 19 extending in the longitudinal direction of receptacle 10 and located adjacent to the longitudinal upper edges of the receptacle. Said carriage 18 is provided with a driving motor 23, shown in dashed lines in FIG. 2 and adapted to permit the carriage to be driven in both longitudinal directions of receptacle 10. At its end facing washing equipment 13, carriage 18 is provided with a number of hose holders, generally designated 20, which are spaced apart in the transversal direction of the carriage and permit hose 16 to be connected releasably with its one end to the carriage in a selected position in the transversal direction of the carriage. At the end facing washing equipment 13, the track for carriage 18 formed by rails 19 extends a length in front of drying chamber 11 to form a parking place 21 for the carriage, where the carriage may be parked when the drying chamber is to be closed by means of cover 12.

As can be seen from FIG. 2, each hose holder 20 of carriage 18 comprises an upper fixed jaw 20', a fixed tongue 20'', located at some distance below jaw 20' and extending in an inclined downward direction from the end wall of the carriage, and a lower movable jaw 20''', having a generally forkshaped outer portion with two upstanding legs which are located each on one side of tongue 20''. By means of the two jaws 20' and 20''', a terminal piece 22 connected to the connection piece 16' of hose 16 may be releasably attached to the carriage in a position resting on the upper portion of tongue 20''. By means of a remote controlled electromagnet, provided behind the cover of the carriage, the movable jaw 20''' may be moved in a downward direction from its illustrated locking position to a lower release position in which said jaw will release terminal piece 22 and permit it to slide out from fixed jaw 20' in a downward direction along tongue 20''.

Carriage 18 has two wheel axles and, as indicated in FIG. 2, its driving motor 23 is adapted to drive the wheel axle located at the end of the carriage turned away from hose holders 20. Hereby it is possible through suitable distribution of the weight of the carriage to ensure that the carriage will not subject a hose 16 connected thereto to a tension of unpermissible magnitude. The tension in the hose will give reason to a torque on the carriage 18, around the wheel axle located nearest hose holders 20. Said torque will normally be balanced by an opposite torque caused by the weight of the carriage. However, when the tensile force in the hose reaches a predetermined value, the size of which is determined by the weight of the carriage and the position of the centre of gravity of the carriage, the first-mentioned torque will tend to tilt the carriage in such a direction as to lift the wheels of the driven axle from rails 19. As soon as the carriage is subjected to such a tilting tendency the driven wheels will start skidding on rails 19. As a consequence, carriage 18 will be stopped automatically and it will be prevented from increasing the tension in the hose further.

Since the carriage 18 is provided with a number of different hose holders 20 which are spaced apart in the transversal direction of the carriage, each hose to be cleaned may be connected to the carriage at a position in the transversal direction of the carriage selected in view of the desired location of the hose in the drying chamber 11. In order to facilitate an appropriate positioning of each hose 16 in drying chamber 11, the washing equipment 13 and the hose magazine 15 are movable in the transversal direction of receptacle 10. Hereby, the position of the washing equipment and the hose magazine may be adjusted to fit the position of the selected hose holder 20 on carriage 18 before starting the cleaning operation on a hose.

The hose cleaning plant above described may be used in the following manner.

Upon preceding soaking, a hose 16 to be cleaned in the plant is placed in coiled state in magazine 15. A short end portion of the hose 16 is unwound from the coil, whereupon a terminal piece 22 is mounted on the hose and placed in a selected hose holder 20 on the carriage 18, which should be in its parking position 21. Simultaneously, the adjacent portion of the hose is inserted in the washing equipment 13 between brushes 17. The washing equipment is then started and carriage 18 is caused to start moving in a direction away from said equipment. Hose 16 will hereby be successively withdrawn from magazine 15 through washing equipment 13 and along drying chamber 11. When the rear end of the hose reaches the washing equipment, carriage 18 is stopped and the hose is taken out from the washing equipment, whereupon the rear end of the hose is connected to a hose connection provided in the drying chamber. Carriage 18 is then started again in order to provide a stretching operation on hose 16, the leading end of which is then released from carriage 18 and permitted to fall down into drying chamber 11, in which the hose now will rest in extended position on a suitable support.

Carriage 18 may now be returned to its parking position 21 adjacent to washing equipment 13, whereupon a washing operation on another hose may be initiated. In this case, another hose holder 20 of the carriage than the one previously used will be utilized. Additionally, magazine 15 and washing equipment 13 are set into new positions adapted to suit the position of the hose holder now to be used. The process above described is then repeated until a suitable number of hoses have been washed and placed side by side in drying chamber 11.

The hoses are now subjected to a hydrostatic pressure test and any leak points are marked in suitable manner. The hoses are then emptied of water, whereupon terminal pieces 22, which are provided with built-in check valves, are removed from the hoses. The drying chamber 11 is then closed by means of cover 12, whereupon a drying process is started during which hot air is blown through the hoses as well as around the same within drying chamber 11. The required drying time may amount, for instance, to one hour. When the drying process has been ended, cover 12 is opened and the hoses are disconnected from the hose connections in the drying chamber, whereupon each hose is wound into a coil by means of a wind-up equipment 14 which may be adjustable in the transversal direction of receptacle 10 in order to permit its position to be adapted to the position of the hose within the drying chamber.

Carriage 18 may, as a whole, be arranged for remote controlled operation from an operator's place adjacent to washing equipment 13. Further, the speed of the carriage 18 may be variable to permit a hose to be drawn through the washing equipment at a speed selected in view of how soiled the hose is. Additionally, the carriage should preferably be adapted to be driven at high speed during its return movement to parking place 21.

The invention is not restricted to the embodiment above described and shown in the drawing. Especially, it should be noted that it may be favourable to use, instead of a drier comprising a single drying chamber, a drier having two parallel drying chambers which may be charged and operated in an alternating manner in order to permit continuous operation of the complete hose cleaning plant. Furthermore, instead of magazine 15, it is possible to use a flat horizontal support on which the coiled hose may be placed in a lying position. In this case, the flat hose will have to be turned 90° around its longitudinal axis during its passage from the coil to the washing equipment.

We claim:

1. A plant for use in connection with cleaning fire hoses or other similar hoses, said plant comprising an elongated horizontal receptacle, in which a number of hoses may be placed side by side in extended positions, washing equipment provided at one end of the receptacle, and a transport device which is movable along the receptacle and by which a hose may be drawn through the washing equipment and along the receptacle, above the same, in order to be laid down in the receptacle upon the completion of a washing operation on said hose, characterized in that said transport device is formed by a carriage which is supported on rails, provided adjacent to the longitudinal upper edges of the receptacle, and which is provided with means for releasably holding an end portion of a hose in a selected position in the transversal direction of the receptacle.

2. A plant according to claim 1, characterized in that said hose holding means comprise a plurality of stationary hose holders which are located at spaced apart positions in the transversal direction of the carriage.

3. A plant according to claim 1 or 2, characterized in that the hose holding means of the carriage are adapted to permit remote controlled release of a hose held by said means.

4. A plant according to claim 1, characterized in that the carriage is adapted to be stopped automatically when the tension in a hose held by the hose holding means reaches a predetermned value.

5. A plant according to claim 4, characterized in that the carriage has two wheel axles and that it is adapted to be driven by supplying driving power to the axle most remote from the hose holding means, the weight of the carriage being distributed so as to cause the carriage to be subjected to a tilting tendency around its axle nearest the hose holding means when the tension in a hose connected to the carriage reaches a predetermined value, said tilting tendency causing the driven wheels of the carriage to start skidding on the rails, thereby automatically stopping the carriage.

6. A plant according to claim 1 or 2, characterized in that the washing equipment is adjustable in the transversal direction of the receptacle in order to permit its position to be adapted to a selected position for the connection between a hose and the carriage.

* * * * *